United States Patent [19]

Holton

[11] 4,036,681

[45] July 19, 1977

[54] DELIGNIFICATION OF LIGNOCELLULOSIC MATERIAL WITH AN ALKALINE PULPING LIQUOR CONTAINING A DIELS ALDER ADDUCT OF BENZOQUINONE OR NAPHTHOQUINONE

[75] Inventor: Harry Hutchinson Holton, Beloeil, Canada

[73] Assignee: Canadian Industries, Ltd., Montreal, Canada

[21] Appl. No.: 750,448

[22] Filed: Dec. 14, 1976

[51] Int. Cl.[2] ..... D21C 3/20; D21C 9/10

[52] U.S. Cl. ..... 162/65; 8/111; 162/72; 162/82; 162/86; 162/90

[58] Field of Search ..... 162/65, 70, 72, 82, 162/83, 84, 86, 90; 8/107, 111; 260/369

[56] References Cited

U.S. PATENT DOCUMENTS 4,012,280 3/1977 Holton ..... 162/65

FOREIGN PATENT DOCUMENTS 43,403 4/1976 Japan ..... 162/72

*Primary Examiner*—Arthur L. Corbin
*Attorney, Agent, or Firm*—Guy Drouin

[57] ABSTRACT

Delignification of lignocellulosic material, such as wood, straw or bagasse, by treatment with an alkaline pulping liquor containing a diketo hydroanthracene selected from the unsubstituted and lower alkyl substituted Diels Alder adducts of benzoquinone and naphthoquinone.

10 Claims, No Drawings

DELIGNIFICATION OF LIGNOCELLULOSIC MATERIAL WITH AN ALKALINE PULPING LIQUOR CONTAINING A DIELS ALDER ADDUCT OF BENZOQUINONE OR NAPHTHOQUINONE

This invention relates to a process for the delignification of lignocellulosic material such as wood, straw, bagasse, etc.

The processing of lignocellulosic material to produce cellulose suitable for the manufacture of paper products involves the removal of lignin and other non-cellulosic components such as gums. Reagents that attack lignin without affecting appreciably the cellulose component are preferred for this purpose. In the sulphate or kraft process lignocellulosic material is cooked with a mixture of sodium hydroxide and sodium sulphide. In the soda process the cooking is carried out with sodium hydroxide alone. In Canadian Pat. No. 895,756 issued on Mar. 21, 1972 to H. E. Worster and M. F. Pudek there is described a two-stage soda-oxygen pulping process comprising a first stage sodium hydroxide digestion, followed by defiberization of the product of the sodium hydroxide digestion, and a second stage digestion with sodium hydroxide in the presence of excess oxygen. This process produces pulp in yield comparable to the yield of a conventional kraft process. Although these processes are effective in the removal of lignin from lignocellulosic material such as wood, the cellulose component of the material is attacked also to a certain degree, resulting in a lowering of yields and degradation of the product.

The contribution to air pollution of volatile mercaptans and hydrogen sulphide is a serious disadvantage of the kraft process. The soda process is superior in this respect; however, the soda process is unsuitable for pulping coniferous woods because of long cooking times and low yields. Even in the case of hardwoods, yields are usually inferior to those achieved using the kraft process. A recent publication (B. Bach and G. Fiehn, Zellstoff Papier 21, No. 1,3-7 January 1972) and a related East German Pat. No. 98,549 of June 20, 1973 disclose the use of anthraquinone-2-monosulphonic acid (AMS) as a means of improving yields in the soda process. More recently, (U.S. Pat. No. 3,888,727) this additive was employed in the first stage of a soda-oxygen process, resulting in yields superior to those of a conventional kraft process; the pulp possessed strength properties comparable to kraft. Unfortunately, the soda-AMS pulping process does not eliminate the odour problem, since sulphur derived from the additive is converted to sulphide in the pulping chemicals recovery systems and thence to mercaptans or hydrogen sulphide during the next cooking cycle. The economic advantages resulting from higher yields are largely offset by the relatively high cost of AMS. Other sulphur-free derivatives were tested by Bach and Fiehn (above recent publication) and were found to be substantially less effective than AMS.

In the United States Patent Application Ser. No. 718,980, filed on Aug. 30, 1976, now U.S. Pat. No. 4,012,280, it is proposed to use, instead of AMS as an additive in an alkaline pulping liquor, a sulphur-free quinone compound such as, among others, naphthoquinone, anthraquinone, anthrone, phenanthrenequinone and the alkyl, alkoxy and amino-derivatives of said quinones. Compared to AMS, these quinone additives have the very great advantages that they do not contribute to pollution and that for a given concentration and under comparable pulping conditions they are more effective.

It has now been found that lignocellulosic material can be delignified in high yield by a process which comprises a digestion with an alkaline pulping liquor in the presence of a diketo hydroanthracene selected from the group consisting of the unsubstituted and the lower alkyl-substituted Diels Alder adducts of naphthoquinone and benzoquinone. The compounds of this group, which are not quinones, have surprisingly been found to afford pulping results at least as good as those obtained with the quinones of the above-identified patent application while offering the major advantage that they can be prepared more readily and more economically. Optionally, the digestion with alkaline pulping liquor may be followed by a second stage digestion in alkaline medium with oxygen or an oxygen-containing gas under pressure. The novel process provides a pulp in higher yield at an increased rate of delignification in comparison to similar processes without additive. In addition, the diketo hydroanthracene additives proposed in this invention are free of sulphur and hence have the marked advantage over the anthraquinone monosulphonic acid proposed in East German Pat. No. 98,549 of producing no polluting sulphur compounds. Furthermore, the concentrations of the diketo anthracene additives required are at an economically advantageous level and often are less than that required with the known quinone additives.

Thus the main object of the invention is to provide a pulping process which gives a high yield of cellulosic pulp. Another object is to provide a pulping process having a high rate of delignification, thus achieving a lower energy consumption and a higher throughput. A further object is to provide a pulping process which has a low pollution potential. A still further object is to provide a pulping process employing additives more readily and more economically prepared than AMS and the quinone additives.

The process of this invention comprises the steps of 1. treating lignocellulosic material in a closed reaction vessel with an alkaline pulping liquor containing from 0.001% to 10.0% by weight, based on the lignocellulosic material, of a diketo hydroanthracene selected from the group consisting of the unsubstituted and lower alkyl-substituted Diels Alder adducts of naphthoquinone or benzoquinone, the treatment taking place of maximum temperature in the range of 150° to 200° C. for a period of 0.5 to 480 minutes, and 2. displacing the pulping liquor from the lignocellulosic material with water or an aqueous liquor inert to the lignocellulosic material to obtain a delignified lignocellulosic material.

The delignified lignocellulosic material produced by the above two steps may be used without further treatment or may be subjected to conventional bleaching steps.

Optionally the delignified lignocellulosic material may be subjected to the following additional treatment steps:

3. treatment of the delignified lignocellulosic material in aqueous suspension at a consistency of 2 to 40% by weight for 0.5 to 60 minutes at 20° to 90° C. with 2 to 20% by weight of an alkali metal base, and 4. treatment of the alkaline material in aqueous medium at a consistency of from 3.0 to 40% by weight with oxygen or an oxygen-containing gas for 0.5 to 120 minutes at a temperature of 80° to 150° C. and a partial pressure of oxygen of 20 to 200 pounds per square inch.

When the lignocellulosic material employed is wood, it is first converted into the form of chips. This step is not required when the lignocellulosic material is of fibrous form.

The lignocellulosic material may be refined between steps (1) and (2) or between steps (2) and (3). Refining can be carried out with known equipment such as a single disc or double disc refiner.

The process of this invention can be used to delignify either coniferous or deciduous species of wood. By coniferous is meant species such as pine, spruce and balsam fir. By deciduous is meant species such as birch, aspen, eastern cottonwood, maple, beech and oak. When treating a high density deciduous wood such as birch, it is preferable to employ a longer time to reach maximum cooking temperature in the first step. In spite of this, however, the overall cooking time is still greatly reduced in comparison with that of the conventional processes using an alkaline liquor without additives. In the case of high density deciduous wood, it is also preferable that the alkali base added in the optional third step be so added while the pulp is at a low consistency, e.g. 2 to 6%.

For the reasons given above, the alkaline pulping liquor ideally suitable for use in the first step of the process of the invention is the soda liquor. However, other conventional alkaline pulping liquors can be used, e.g. the kraft or polysulphide liquor, in which case environmental effects are still present but, due to the presence of the additives of the invention, the pulping action is accelerated and yields are increased.

The soda liquor contains from 8 to 20% by weight of alkali metal base expressed as percent effective alkali, based on the weight of the lignocellulosic material, and normally also contains alkali metal carbonate. Digestion with this liquor in the presence of the diketo anthracene additives according to the invention results in certain cases, in the cooking time being lessened by a factor of four.

The kraft or sulphate liquor contains from 8 to 15% by weight of alkali metal base expressed as percent effective alkali (TAPPI T-1203 S-61) and from 5 to 40% by weight of alkali metal sulphide expressed as percent sulphidity (TAPPI T-1203 OS-61), based on lignocellulosic material. This pulping liquor will normally contain alkali metal sulphate and alkali metal carbonate. The pulping liquor may contain excess sulphur, i.e. polysulphides. The presence of polysulphides results in an improved yield and an amount of 1.0 to 5.0%, preferably 2.0% thereof (expressed as sulphur and based on weight of lignocellulosic material) in the liquor is therefore a definite advantage.

Effective alkali is the sum of all alkali hydroxide in solution expressed as $Na_2O$ including that formed by hydrolysis of the alkali sulphide, also expressed as $Na_2O$.

Sulphidity is the total sulphide, expressed as $Na_2O$, calculated as a percentage of total titrable alkali, including that formed by hydrolysis of the sulphide, also expressed as $Na_2O$.

Since the first step treatment of the process is carried out in a closed reaction vessel at a temperature in the range of from 150° to 200° C. in the presence of water, the reaction will take place under supra atmospheric pressure.

As mentioned above, the compounds which are suitable for use as additives in the process of the invention are the diketo hydroanthracenes selected from the group consisting of the unsubstituted and lower alkyl-substituted Diels Alder adducts of naphthoquinone or benzoquinone. More particularly, the unsubstituted Diels Alder adducts are those obtained by reacting 1 or 2 mols of butadiene with naphthoquinone and benzoquinone respectively and the lower alkyl-substituted adducts are those obtained where in the above reaction either one or both of the reactants are substituted with the appropriate lower alkyl groups. The alkyl groups in the lower alkyl substituted Diels Álder adducts may range in number from 1 to 4, may each contain from 1 to 4 carbon atoms and may be the same or different. Examples of the above diketo anthracenes are 1,4,4*a*,5,8,8*a*,9*a*, 10*a*-octahydro-9,10-diketo anthracene, 2,3,6,7-tetramethyl-1,4,4*a*,5,8,8*a*,9*a*,10*a*-octahydro-9,10-diketo anthracene, 1,4,4*a*,9*a*-tetrahydro-9,10-diketo anthracene, 2-ethyl-1,4,4*a*,9*a*-tetrahydro-9,10-diketo anthracene, 2,3-dimethyl-1,4,4*a*,9*a*-tetrahydro-9,10-diketo anthracene and 1,3-dimethyl-1,4,4*a*,9*a*-tetrahydro-9,10-diketo anthracene. The additive is employed in proportions of from 0.001 to 10.0%, preferably 0.01 to 1.0% by weight based on the lignocellulosic material.

After the first step treatment with pulping liquor the resulting pulp yield will be about 40 to about 70%, by weight, based on the lignocellulosic material. The kappa number of the material at completion of the first step will lie in the range 10 to 150 for coniferous woods and in the range 5 to 100 for deciduous woods.

The partially delignified material resulting from the first treatment step is discharged from the pulping vessel and the spent liquor displaced by fresh water or optionally by an aqueous liquor inert to lignocellulosic material such as the spent liquor from the alkaline oxygen treatment step or "white water" from a later stage of a paper making process.

Optionally, the delignified lignocellulosic material may then be subjected to an alkaline oxygen treatment. To the material is added alkali metal base. The alkali metal base may be provided in the form of pulping liquor such as used in the first step of the process. This liquor, depending upon whether it is a soda liquor or a kraft liquor, may therefore contain carbonate or sulphide, sulphate and carbonate in addition to alkali metal base. Where the pulping liquor is a kraft liquor, it may be of advantage to oxidize the liquor by aeration with an oxygen-containing gas prior to its addition to the delignified lignocellulosic material. Preferably there is also added from 0.1 to 1.0% by weight of the pulp of a magnesium salt such as magnesium chloride or magnesium sulphate calculated as magnesium ion. The magnesium salt may be added directly as the salt or as a complex formed with the spent liquor from the alkaline oxygen treatment step.

The alkaline treated material is then fed into an oxygen treatment vessel. The material is there treated with oxygen or an oxygen-containing gas under a partial pressure of oxygen of from 20 to 200 pounds per square inch. The product of the oxygen treatment is separated from the spent liquor and washed with water. It will have a residual lignin content of from 1 to 6%, preferably from 1.5 to 4.5% of the weight of the original lignocellulosic material corresponding to a yield of from 80 to 98% by weight of the pulp entering the oxygen treatment.

The alkali metal base employed as reagent in the process of this invention may be sodium hydroxide, potassium hydroxide, sodium carbonate or potassium carbonate. The alkali metal sulphide may be sodium sulphide or potassium sulphide.

The material resulting from step (2) may be bleached by any conventional bleaching process. A conventional sequence comprising chlorination, alkaline extraction, chlorine dioxide treatment, alkaline extraction, chlorine dioxide treatment (C-E-D-E-D) when applied to the material resulting from step (2), will provide a product having a brightness of approximately 85–90 units (Elrepho). The material resulting from step (4) may be bleached by the sequence chlorination, alkaline extraction, chlorine dioxide treatment (C-E-D) or any other conventional sequence. When applied to the material resulting from step (4), the sequence C-E-D will provide a product having a brightness of approximately 85–90 units (Elrepho).

The process of this invention has the advantage that the additives are effective at concentrations that are economically favourable and that it also requires a lower amount of pulping chemicals. Compared with the conventional pulping processes wherein no additives are used, the process of this invention provides a pulp in higher yield at an increased rate of delignification, thus permitting lower raw material cost, lower energy consumption and higher throughput. Another advantage of the process is that it results in lessened pollution potential as compared with the process of East German Pat. No. 98,549. This latter advantage is only significant if soda pulping is used as against kraft or polysulphide pulping.

Still another advantage of the present invention over the process described in said East German patent is that, for a given concentration and under comparable pulping conditions, the present additives and especially the alkyl derivatives are more effective than AMS.

The invention is illustrated by the following Examples but its scope is not limited to the embodiments shown therein.

In the Examples the kappa number and viscosity determinations were carried out by the following methods.

Kappa number: TAPPI method T-236 M-60

Viscosity: TAPPI method T-230 SU-66

In all the following Examples, pulping was carried out in stainless steel pressure vessels of either one of the following two types: (1) a set of three such vessels, each containing a rotatable horizontal basket, and (2) an assembly of eight such vessels (hereinafter called the microdigester assembly) each of which is itself horizontally rotatable. Large size samples of chips of 300, 600 or 2400 grams (oven dried weight) were pulped in any one of the three vessels of the first type while small size samples of 75 grams were pulped eight at a time in the second type of vessels, i.e. in the microdigester assembly. The chips were dried to approximately 90% consistency, divided into appropriate portions in consideration of the number and size of the pulping runs to be carried out and stored at 4° C. Exact amounts of chips of accurately known consistency were weighed out and soaked 24 hours in water prior to pulping. Soaked chips were placed inside the pressure vessel and optionally pre-steamed for 10 minutes. Pulping liquor and dilution water were than added in the amounts required to give the desired effective alkali and to obtain a liquor to wood ratio of 4:1. Indirect electrical heating was used in both types of vessels. In the case of the microdigester assembly, water under pressure was employed as a heat transfer medium. Heating was controlled to linearly raise the temperature to a preset maximum in a given time and to maintain it within ± 2° C. of said maximum to the end of the cooking period.

After completion of the cooking, the pressure was released and the pulp together with the used cooking liquor was transferred to a mixer such as a Cowles dissolver, diluted to 2% consistency and stirred for 5 minutes to simulate the blowdown of pulp that occurs in a commercial scale digesters. The pulp was then washed twice by dilution to 2% consistency with water and filtered and pressed to 25% consistency. The pulp was then crumbed in a Hobart mixer, weighed and samples were taken for yield, kappa number and viscosity measurements.

EXAMPLE 1

Seven samples of chips from a variety of wood species were subjected to pulping treatment employing soda pulping liquor containing diketo hydroanthracenes according to the invention as additives, or soda pulping liquor without additive. Cooking with pulping liquor was carried out using the digester and procedure described immediately above. Th characteristics of the 7 pulping runs are shown in Table I and the results obtained are shown in Table II.

TABLE I

| | SODA PULPING CONDITIONS | | | Pulping Conditions | | |
|---|---|---|---|---|---|---|
| Run No. | Additive | % on wood | Wood species | Max. temp. ° C. | Time to temp. min. | Time at temp. min. |
| 1 | 1,4,4a,5,8,8a,9a,10a-OCTAHYDRO-9,10-DIKETO ANTHRACENE | 0.25 | B.S. | 170 | 90 | 80 |
| 2 | 2-ETHYL-1,4,4a,9a-TETRAHYDRO-9,10-DIKETO ANTHRACENE | 0.25 | B.S. | 170 | 90 | 80 |
| 3 | 2,3-DIMETHYL-1,4,4a,9a-TETRAHYDRO-9,10-DIKETO ANTHRACENE | 0.25 | B.S. | 170 | 90 | 80 |
| 4 | 1,4,4a,9a-TETRAHYDRO-9,10-DIKETO ANTHRACENE | 0.25 | B.S. | 170 | 90 | 80 |
| 5 | 2,3,6,7-TETRAMETHYL-1,4,4a,5,8,8a,9a,10a-OCTAHYDRO-9,10-DIKETO ANTHRACENE | 0.25 | B.S. | 170 | 90 | 80 |
| 6 | 1,3-DIMETHYL-1,4,4a,9a-TETRAHYDRO-9,10 DIKETO ANTHRACENE | 0.25 | B.S. | 170 | 90 | 80 |
| 7 | 1,4,4a,5,8,8a,9a,10a- | | | | | |

TABLE I-continued

| SODA PULPING CONDITIONS | | | | Pulping Conditions | | |
|---|---|---|---|---|---|---|
| Run No. | Additive | % on wood | Wood species | Max. temp. °C. | Time to temp. min. | Time at temp. min. |
| | OCTAHYDRO-9,10-DIKETO ANTHRACENE | 0.10 | M.H. | 165 | 120 | 150 |

B.S. = Black Spruce
M.H. = Mixed Hardwoods

TABLE II

| SODA PULPING RESULTS | Results without Additive | | | | Results with Additive | | | |
|---|---|---|---|---|---|---|---|---|
| Run No. | Eff. alkali % | Kappa No. | Yield % | Viscosity cps | Eff. alkali % | Kappa No. | Yield % | Viscosity cps |
| 1 | 15.5 | 121.7 | 61.0 | — | 15.5 | 43.8 | 51.7 | — |
| 2 | 15.5 | 115.1 | 56.1 | — | 15.5 | 37.5 | 51.2 | — |
| 3 | 15.5 | 115.1 | 56.1 | — | 15.5 | 35.6 | 50.7 | — |
| 4 | 15.5 | 121.7 | 61.0 | — | 15.5 | 41.5 | 52.2 | — |
| 5 | 15.5 | 85.7 | 56.3 | — | 15.5 | 50.4 | 51.7 | — |
| 6 | 15.5 | 85.7 | 56.3 | — | 15.5 | 36.7 | 51.5 | — |
| 7 | 14.0 | 57.3 | 56.4 | — | 14.0 | 24.0 | 52.1 | — |

EXAMPLE 2

Seventeen samples of black spruce chips were subjected to pulping treatment employing soda pulping liquor containing diketo hydroanthracene according to the invention as additives. Samples 1 to 9 of these seventeen samples were also subjected to pulping treatment employing soda pulping liquor without additive. Cooking with pulping liquor was carried out using the same digesters and procedure as in Example 1. The characteristics of the 17 pulping runs are shown in Table III and the results obtained are shown in Table IV.

TABLE III

| SODA PULPING CONDITIONS | | | Pulping Conditions | | |
|---|---|---|---|---|---|
| Run No. | Additive | % on wood | Max. temp. °C. | Time to temp. min. | Time at temp. min. |
| 1 | 1,4,4a,5,8,8a,9a,10a-OCTAHYDRO-9,10-DIKETO ANTHRACENE | 0.001 | 170 | 90 | 80 |
| 2 | " | 0.005 | 170 | 90 | 80 |
| 3 | " | 0.01 | 170 | 90 | 80 |
| 4 | " | 0.05 | 170 | 90 | 80 |
| 5 | " | 0.10 | 170 | 90 | 80 |
| 6 | " | 0.25 | 170 | 90 | 80 |
| 7 | " | 0.50 | 170 | 90 | 80 |
| 8 | " | 0.75 | 170 | 90 | 80 |
| 9 | " | 1.00 | 170 | 90 | 80 |
| 10 | " | 0.25 | 170 | 90 | 80 |
| 11 | " | 1.00 | 170 | 90 | 80 |
| 12 | " | 0.25 | 170 | 90 | 80 |
| 13 | " | 1.00 | 170 | 90 | 80 |
| 14 | " | 0.25 | 170 | 90 | 80 |
| 15 | " | 1.00 | 170 | 90 | 80 |
| 16 | " | 0.25 | 170 | 90 | 80 |
| 17 | " | 1.00 | 170 | 90 | 80 |

TABLE IV

| SODA PULPING RESULTS | Results without Additive | | | | Results with additive | | | |
|---|---|---|---|---|---|---|---|---|
| Run No. | Eff. alkali % | Kappa No. | Yield % | Viscosity cps | Eff. alkali % | Kappa No. | Yield % | Viscosity cps |
| 1 | 15.5 | 102.3 | 53.7 | — | 15.5 | 91.8 | 51.7 | — |
| 2 | 15.5 | 102.3 | 53.7 | — | 15.5 | 89.5 | 51.2 | — |
| 3 | 15.5 | 102.3 | 53.7 | — | 15.5 | 76.4 | 50.3 | — |
| 4 | 15.5 | 102.3 | 53.7 | — | 15.5 | 47.8 | 47.6 | — |
| 5 | 15.5 | 102.3 | 53.7 | — | 15.5 | 49.1 | 48.2 | — |
| 6 | 15.5 | 102.3 | 53.7 | — | 15.5 | 37.0 | 49.0 | 27.0 |
| 7 | 15.5 | 106.9 | 55.5 | — | 15.5 | 28.4 | 48.8 | 24.8 |

TABLE IV-continued

| SODA PULPING RESULTS | Results without Additive | | | | Results with additive | | | |
|---|---|---|---|---|---|---|---|---|
| Run No. | Eff. alkali % | Kappa No. | Yield % | Viscosity cps | Eff. alkali % | Kappa No. | Yield % | Viscosity cps |
| 8 | 15.5 | 106.9 | 55.5 | — | 15.5 | 24.4 | 48.8 | 24.8 |
| 9 | 15.5 | 106.9 | 55.5 | — | 15.5 | 21.3 | 47.8 | 24.9 |
| 10 | — | — | — | — | 12.4 | 59.6 | 53.2 | — |
| 11 | — | — | — | — | 12.4 | 41.4 | 52.6 | 38.6 |
| 12 | — | — | — | — | 14.0 | 43.8 | 50.9 | 32.0 |
| 13 | — | — | — | — | 14.0 | 30.3 | 50.1 | 39.6 |
| 14 | — | — | — | — | 15.5 | 34.2 | 49.1 | 25.5 |
| 15 | — | — | — | — | 15.5 | 23.7 | 48.5 | 26.0 |
| 16 | — | — | — | — | 17.1 | 28.5 | 48.0 | 21.4 |
| 17 | — | — | — | — | 17.1 | 19.8 | 47.4 | 21.0 |

EXAMPLE 3

Nine samples from a variety of wood species were subjected to pulping treatment employing kraft pulping liquor containing diketo hydroanthracenes according to the invention as additives, or kraft pulping liquor without additive. Cooking was carried out using the same digester and procedure as in Example 1. In runs 1-5 and 7–9, the liquor was heated to a maximum temperature of 170° C. in 90 minutes and was maintained there for 80 minutes. The liquor of run 6 was heated to a maximum temperature of 165° C. in 120 minutes and was kept there for 150 minutes. In all the runs, sulphidity was 25%. The results obtained with the nine pupling runs are shown in Table V.

TABLE V

| | | KRAFT PULPING RESULTS | | | | | | | | | |
|---|---|---|---|---|---|---|---|---|---|---|---|
| | | | | Results without Additive | | | | Results with Additive | | | |
| Run No. | Additive | % on wood | Wood species | Eff. alkali % | Kappa No. | Yield % | Viscosity cps | Eff. alkali % | Kappa No. | Yield % | Viscosity cps |
| 1 | 1,4,4a,5,8,8a,9a,10a-OCTAHYDRO-9,10-DIKETO ANTHRACENE | 0.25 | B.S. | 13.0 | 47.1 | 50.6 | — | 13.0 | 34.2 | 49.5 | 43.5 |
| 2 | " | 0.50 | B.S. | 13.0 | 47.1 | 50.6 | — | 13.0 | 30.3 | 51.4 | 42.5 |
| 3 | " | 0.75 | B.S. | 13.0 | 47.1 | 50.6 | — | 13.0 | 28.4 | 50.4 | 42.0 |
| 4 | " | 1.00 | B.S. | 13.0 | 47.1 | 50.6 | — | 13.0 | 27.9 | 49.8 | 37.1 |
| 5 | " | 0.25 | B.S. | 14.0 | 39.8 | 49.1 | 47.0 | 14.0 | 25.7 | 47.3 | 35.2 |
| 6 | " | 0.10 | M.H. | 15.5 | 15.6 | 49.5 | — | 15.5 | 15.1 | 50.0 | — |
| 7 | 2-ETHYL-1,4,4a,9a-TETRAHYDRO-9,10-DIKETO ANTHRACENE | 0.25 | B.S. | 14.0 | 41 | 50.5 | 38.7 | 14.0 | 29.7 | 51.5 | 35.8 |
| 8 | 2,3-DIMETHYL-1,4,4a,9a-TETRA-HYDRO-9,10-DIKETO ANTHRACENE | 0.25 | B.S. | 14.0 | 41 | 50.5 | 38.7 | 14.0 | 28.3 | 50.9 | 35.2 |
| 9 | 1,3-DIMETHYL-1,4,4a,9a-TETRA-HYDRO-9,10-DIKETO ANTHRACENE | 0.25 | B.S. | 14.0 | 41 | 50.5 | 38.7 | 14.0 | 35.1 | 50.4 | 38.0 |

Wood Species:
B.S. = Black Spruce
M.H. = Mixed Hardwoods

EXAMPLE 4

Eight samples of chips from a variety of wood species were subjected to pulping treatment employing polysulphide pulping liquor containing diketo hydroanthracenes according to the invention as additives, or polysulphide pulping liquor without additive. Cooking was carried out using the same digester and procedure as in Example 1. In all the runs the polysulphide liquor was an ordinary kraft liquor of 25% sulphidity with sulphur added thereto in the amount of 2% by weight based on wood.

In runs 1 to 7, effective alkalinity was 14% and the liquor was heated to a maximum temperature of 170° C. in 90 minutes and was maintained there for 80 minutes. The liquor of run 8 had 15.5% effective alkali, was heated to a maximum temperature of 165° C. in 120 minutes and was kept at that temperature for 150 minutes. The results obtained with the eight runs are shown in Table VI.

TABLE VI

| | | KRAFT (POLYSULPHIDE) PULPING RESULTS | | | | | | | |
|---|---|---|---|---|---|---|---|---|---|
| | | | | Results without Additive | | | Results with Additive | | |
| Run No. | Additive | % on wood | Wood species | Kappa No. | Yield % | Viscosity cps | Kappa No. | Yield % | Viscosity cps |
| 1 | 1,4,4a,8,8a,9a,10a-OCTAHYDRO-9,10-DIKETO ANTHRACENE | 0.13 | B.S. | 34.7 | 51.4 | 54.6 | 29.2 | 51.9 | 47.2 |
| 2 | " | 0.25 | B.S. | 34.7 | 51.4 | 54.6 | 27.6 | 52.3 | 45.7 |
| 3 | " | 0.50 | B.S. | 34.7 | 51.4 | 54.6 | 24.3 | 51.9 | 40.6 |
| 4 | " | 1.00 | B.S. | 34.7 | 51.4 | 54.6 | 22.4 | 52.3 | 38.3 |
| 5 | 2,3-DIMETHYL-1,4,4a,9a-TETRAHYDRO-9,10-DIKETO ANTHRACENE | 0.25 | B.S. | 36.4 | 52.3 | 48.1 | 29.2 | 52.7 | 42.9 |
| 6 | 2-ETHYL-1,4,4a,9a-TETRA-HYDRO-9,10-DIKETO ANTHRACENE | 0.25 | B.S. | 36.4 | 52.3 | 48.1 | 31.0 | 53.2 | 41.7 |
| 7 | 1,3-DIMETHYL-1,4,4a,9a-TETRAHYDRO-9,10-DIKETO ANTHRACENE | 0.25 | B.S. | 36.4 | 52.3 | 48.1 | 33.0 | 51.4 | 43.5 |
| 8 | 1,4,4a,8,8a,9a,10a-OCTAHYDRO-9,10-DIKETO ANTHRACENE | 0.10 | M.H. | 17.0 | 52.0 | — | 16.4 | 52.6 | — |

Wood Species:
B.S. = Black Spruce
M. H. = Mixed Hardwoods

EXAMPLE 5

Six samples of black spruce chips (B.S.) were subjected to pulping treatment using the same digester and procedure as in Example 1. Soda, kraft and polysulphide pulping liquors were used in runs 1,3 and 5 respectively without additive and also in runs 2, 4 and 6 respectively but with 1,4,4*a*,5,8,8*a*,9*a*,10*a*-octahydro-9,10-diketo anthracene as an additive. The characteristics and pulping results of the six runs are shown in Table VII.

The six runs were then subjected to alkaline oxygen treatment. In this treatment, the pulp at a consistency of 35% by weight was treated with sodium hydroxide. Then at a consistency of 26% by weight, the alkaline pulp was treated in a pressure vessel with oxygen, at a pressure of 90 pounds per square inch. In the six runs, $Mg^{++}$ was added to the sodium hydroxide in the amount of 0.2% on pulp. The characteristics and results of the oxygen pulping stage are shown in Table VIII.

In the six runs, the pulps were refined prior to measurement of kappa number and further treatment. Refining was done in one pass through a laboratory Sprout-Waldron refiner at 0.005 inch clearance.

TABLE VII

OXYGEN PULPING WITH DIELS ADLER ADDUCTS - PULPING DATA

| Run No. | Pulp Type | Additive | % on wood | Wood species | Eff. alkali % | Sulphidity % | Max. temp. ° C. | Time to temp. min. | Time at temp. min. | Kappa No. | Yield % on wood |
|---|---|---|---|---|---|---|---|---|---|---|---|
| 1 | Soda-Oxygen | | | B.S. | 15.5 | | 170 | 90 | 90 | 82.5 | 53.8 |
| 2 | Soda-Additive-Oxygen | 1,4,4a,5,8,8a,9a,10a-OCTAHYDRO-9,10-DIKETO ANTHRACENE | 0.25 | B.S. | 12.4 | | 170 | 90 | 64 | 83.3 | 57.3 |
| 3 | Kraft-Oxygen | | | B.S. | 12.0 | 25.0 | 170 | 60 | 30 | 101.1 | 59.7 |
| 4 | Kraft-Additive-Oxygen | 1,4,4a,5,8,8a,9a-10a-OCTAHYDRO-9,10-DIKETO ANTHRACENE | 0.25 | B.S. | 11.0 | 25.0 | 170 | 60 | 30 | 101.3 | 62.2 |
| 5 | Polysulphide Oxygen (2% Sulphur) | | | B.S. | 12.0 | 25.0 | 170 | 60 | 30 | 99.7 | 62.5 |
| 6 | Polysulphide-Additive-Oxygen (2% Sulphur) | 1,4,4a,5,8,8a,9a,10a-OCTAHYDRO-9,10-DIKETO ANTHRACENE | 0.25 | B.S. | 11.0 | 25.0 | 170 | 60 | 30 | 94.3 | 62.9 |

TABLE VIII

OXYGEN PULPING WITH DIELS ALDER ADDUCTS

| | OXYGEN STAGE | | | | | | |
|---|---|---|---|---|---|---|---|
| Run No. | NaOH % on pulp | Temp. ° C. | Time min. | Kappa No. | Yield % on pulp | Yield % on wood | Viscosity cps |
| 1 | 6.6 | 120 | 30 | 27.1 | 91.0 | 48.9 | 9.4 |
| 2 | 6.7 | 120 | 30 | 26.4 | 88.9 | 50.9 | 13.3 |
| 3 | 8.1 | 120 | 30 | 30.1 | 85.5 | 51.0 | 11.9 |
| 4 | 8.1 | 120 | 30 | 31.8 | 85.9 | 53.4 | 12.2 |
| 5 | 8.0 | 120 | 30 | 31.0 | 85.8 | 53.6 | 11.9 |
| 6 | 7.5 | 120 | 30 | 30.3 | 87.5 | 55.0 | 13.6 |

What we claim is:

1. A process for the delignification of lignocellulosic material comprising the steps of 2. treating the lignocellulosic material in a closed reaction vessel with an alkaline pulping liquor containing from 0.001 to 10.0% by weight, based on the lignocellulosic material, or a diketo hydroanthracene selected from the group consisting of the unsubstituted and lower alkyl substituted Diels Alder adducts of naphthoquinone and benzoquinone, the treatment taking place at a temperature in the range of from 150° to 200° C. for a period of 0.5 to 480 minutes, and 2. displacing the pulping liquor from the lignocellulosic material with water or an aqueous liquor inert to the lignocellulosic material to obtain a delignified lignocellulosic material.

2. A process as claimed in claim 1 wherein the lower alkyl substituted Diels Alder adducts are adducts substituted with 1 to 4 alkyl groups which may be the same or different and may each contain 1 to 4 carbon atoms.

3. A process as claimed in claim 1 wherein the diketo hydroanthracene is selected from the group consisting of 1,4,4a,9a-tetrahydro-9,10-diketo anthracene, 2-ethyl-1,4,4a,9a-tetrahydro-9,10-diketo anthracene, 2,3-dimethyl-1,4,4a,9a-tetrahydro-9,10-diketo anthracene, 1,3-dimethyl-1,4,4a,9a-tetrahydro-9,10-diketo anthracene, 1,4,4a,5,8,8a,9a,10a-octahydro-9,10-diketo anthracene and 2,3,6,7-tetramethyl-1,4,4a,5,8,8a,9a,10a-octahydro-9,10-diketo anthracene.

4. A process as claimed in claim 1 wherein the alkaline pulping liquor contains from 0.01 to 1.0% by weight based on the lignocellulosic material, of the diketo hydroanthracene.

5. A process as claimed in claim 1 wherein the alkaline pulping liquor is a soda liquor.

6. A process as claimed in claim 1 wherein the alkaline pulping liquor is a kraft liquor.

7. A process as claimed in claim 6 wherein the kraft liquor contains from 1.0 to 5.0% by weight (based on weight of lignocellulosic material) of polysulphides expressed as sulphur.

8. A process as claimed in claim 1 wherein the delignified lignocellulosic material is subjected to the following additional steps:

3. treatment of the delignified lignocellulosic material in aqueous suspension at a consistency of from 2 to 40% by weight for from 0.5 to 60 minutes at from 20° to 90° C. with from 2 to 20% by weight of an alkali metal base and 4. treatment of the alkali metal base treated material in an aqueous medium at a consistency of from 3.0 to 40% by weight with oxygen or an oxygen-containing gas for from 0.5 to 120 minutes at a temperature of from 80° to 150° C. and a partial pressure of oxygen of from 20 to 200 pounds per square inch.

9. A process as claimed in claim 8 wherein the oxygen-treated material is subjected to conventional bleaching.

10. A process as claimed in claim 1 wherein the delignified lignocellulosic material is subjected to conventional bleaching.

* * * * *